United States Patent [19]

Neros et al.

[11] 3,954,647

[45] May 4, 1976

[54] INDUSTRIAL DRYCLEANING DETERGENT

[75] Inventors: Clifford A. Neros, Willoughby, Ohio; Robert A. Ward, Trenton, Mich.

[73] Assignee: Anscott Chemical Industries, Inc., Fairfield, N.J.

[22] Filed: May 23, 1974

[21] Appl. No.: 472,592

[52] U.S. Cl. ..... 252/153; 252/542; 252/171; 8/142

[51] Int. Cl.[2] ..... D06L 1/00; C11D 3/28

[58] Field of Search ..... 252/547, 542, 153, 171; 8/142; 260/282, 309.6

[56] References Cited

UNITED STATES PATENTS

| | | | |
|---|---|---|---|
| 3,330,015 | 7/1967 | Sieber | 26/19 |
| 3,433,745 | 3/1969 | Knaggs et al. | 252/547 X |
| 3,433,746 | 3/1969 | Knaggs et al. | 252/547 X |
| 3,635,656 | 1/1972 | Piepmeyer | 8/142 |
| 3,715,186 | 2/1973 | Anninos | 8/142 |

*Primary Examiner*—Mayer Weinblatt
*Assistant Examiner*—Charles R. Wolfe, Jr.
*Attorney, Agent, or Firm*—Robert J. Henry; Bernhard R. Swick; Robert E. Dunn

[57] ABSTRACT

Improved drycleaning results (when compared on the International Fabricare Institute rating scale of cleaning/greying ratios) are obtained by the addition of up to one ounce per gallon of drycleaning solvent of a 1-hydroxyethyl-2-fatty acid imidazoline and "free" water (water added after an emulsion of water and detergent is formed in the drycleaning bath).

10 Claims, No Drawings

INDUSTRIAL DRYCLEANING DETERGENT

BACKGROUND OF THE INVENTION

1. Field of the Invention

The use of 1-hydroxyethyl-2-fatty acid imidazolines as a detergent in combination with free water added to an organic drycleaning solvent yields greatly improved drycleaning results.

2. Description of the Prior Art

Recent years have seen a rapid growth in the use of various solvents, notably perchloroethylene, trichloroethylene and Stoddard solvent, for the drycleaning of synthetic and natural fiber materials on both a professional (retail outlet) and industrial (rental garments) level. However, while a number of advances have been made, certain problems still exist. Foremost among these problems is the inability of the organic solvents to remove water-soluble soils.

Basically, the types of soils present on any article to be cleaned fall into three categories, i.e., water-soluble, solvent-soluble and insoluble. Obviously, the removal of solvent-soluble soils present little difficulty and, in fact, is one of the chief advantages of the use of drycleaning, as opposed to "wet" cleaning, processes. Likewise, the removal of insoluble soils presents no greater problem in drycleaning than in wet cleaning operations since the method of removal of these soils is basically mechanical. The chief problem with drycleaning systems therefore has been in the removal of water-soluble soils from the articles to be cleaned. That these water-soluble soils cannot be effectively removed by the solvents used in drycleaning is obvious.

In the usual commercial practice of drycleaning articles of clothing, the soiled garments are agitated in a perforated cylinder to remove oil, grease stains and particles of soil. Small quantities of water and detergent are also added to the solvent to help remove water-soluble soil and provide detergency. According to known practice, the drycleaning solvent is repeatedly recirculated through a filter to remove the soil particles from the solvent. After this cleaning phase, the solvent is drained from the cylinder and the garments are extracted (spun) to remove the bulk of the solvent from the wet load. The residual solvent and moisture deposited in the clothes are then removed by drying.

This usual commercial practice is suitable for the average soiled domestic garment such as trousers or coats which generally never lost more than about one to two pounds of soil per 100 pounds of clothes cleaned. However, such practice is unsatisfactory when the soil load in dirty garments increases greatly, e.g., from about 10 to 50 times greater than that normally handled in drycleaning the average soiled domestic garments. These high-soil loads are often found in the industrial garment or fabric. Typically, industrial garments and fabrics such as wiper cloths can have more than 50 pounds of soil in a 100-pound load of dirty cloths. When these soiled industrial garments are agitated in the organic solvent which is then recirculated in the usual way through a filter to remove the soil particles suspended in the solvent, filtration problems are encountered. The soil load is so great that filter pressure raises at such a rate that usually only one to three loads can be processed before flow completely stops. This poor filtration or lack of filtration makes it virtually impossible to satisfactorily dryclean by this known practice.

The most common method perhaps for drycleaning highly soiled garments requires an initial degreasing cycle. In the degreasing cycle, the dirty garments are flushed with solvent in a batch operation to remove the major portion of the solvent-soluble soil. The solvent is then removed from the washing system by extraction (spun off) and sent to a still along with dissolved grease, suspended insoluble soil, etc. After degreasing, new solvent is brought into contact with the clothes in the washer and this solvent is repeatedly recirculated through a filter to remove supposedly insoluble soil that was not removed in the degreasing cycle. Then the washer is isolated from the filtration equipment and put back on a batch operation in which soap and water are added to remove the water-soluble soil and/or texturizers and sizes are added to improve the hand of the fibrous material.

In this last-mentioned method, the drycleaning technique is so completely unsatisfactory that the garments must often be washed after drycleaning to make them presentable to customers. Because degreasing solvent has essentially no ability to suspend insoluble soil, it will redeposit back into the garment almost immediately unless removed from the system. However, since the garments cannot be safely filtered in view of the soil load, redeposition of insoluble soil on the garment takes place before the solvent is removed, especially in this batch operation. Many dingy and dirty garments generally come out of this cleaning cycle because of these conditions. Moreover, when water-soluble soil is attempted to be removed from the garment as to the last laundering phase of this known method, this attempt not only fails to remove the water-soluble soil but also tends to degrade garments much faster than even the degreasing operation.

It has, therefore, become essential that a drycleaning technique be provided which offers a satisfactory solution to the problems encountered in the presently proposed methods of cleaning highly soiled garments of the industrial type. There is a need for a drycleaning process which not only adequately removes all major types of soil and prevents redeposition of that soil but also prevents degradation of the fabric or garment. This is especially true since newly developed synthetics and synthetic blends, particularly those treated with permanent press finishes, cannot satisfactorily be washed. Moreover, it is important that other properties be obtained in such a process which make the garments presentable in addition to being clean.

SUMMARY OF THE INVENTION

In accordance with this invention, there is provided an improved drycleaning detergent and means of drycleaning comprising adding to the conventional organic drycleaning solvent from about 0.05 to about one ounce per gallon of solvent of a 1-hydroxyethyl-2-fatty acid imidazoline and in the presence of free water and, thereafter, cleaning in the normal one or more stage method.

DESCRIPTION OF THE PREFERRED EMBODIMENTS

The 1-hydroxyethyl-2-fatty acid imidazoline detergents of this invention are cationic materials. For convenience, unless otherwise indicated herein, these detergents will simply be referred to as imidazoline. The imidazoline can be structurally represented by the following formula:

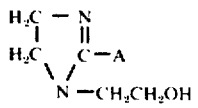

wherein A is fatty acid moiety containing from 10 to 18 carbon atoms, e.g., tall oil fatty acid, palm oil fatty acid, coconut oil fatty acid, stearyl, oleyl, lauryl, palmityl, myristyl and the like. Especially preferred are tall oil fatty acid, coconut oil fatty acid and oleyl acid moieties.

It will be noted from the foregoing that the fatty acid moiety can be either a single moiety, e.g., stearyl or oleyl, or a mixture of several as when the fatty acids from coconut oil are employed. Tall oil fatty acids, coconut oil fatty acids, palm oil fatty acids and the like are conveniently referred to as though they were a single acid moiety even though it is recognized that they are each a mixture of acid moieties the nature and amount of each individual component being well known and readily available in the literature. For the purpose of this invention, the term "fatty acid" embraces all of the foregoing variants.

The amount of imidazoline added to the conventional organic drycleaning solvent will vary according to the particular imidazoline added, the amount of water added and the amount and type of soil to be removed. Typically, the amount of imidazoline added will be from about 0.05 to about 1 ounce per gallon of organic drycleaning solvent and preferably from about 0.1 to about 0.6 ounce per gallon.

One characteristic of a good cleaning agent is that it will prevent redeposition of the soil on the cleaned fibrous material (fabric or garment) and the Cleaning/-Greying ratio, hereafter referred to as C/G, reflects this property. The ratio is arrived at by dividing the cleaning index by the greying index. Each index value is obtained by reflectance readings on the fabric or garment before and after cleaning. The ratio of reflectance change for each detergent to that of the reference detergent gives an index number permitting comparison of test data made at different times or under slightly different conditions. The ratio of the unsoiled swatch reflectance changes is called the "greying index" and that of the soiled fabrics is the "cleaning index". The lower the greying index and the higher the cleaning index, the better the detergent. The test is described in National Institute of Drycleaning Technical Bulletin T-444. The resulting dimensionless number is an excellent basis of comparison of cleaning performance between detergents and varying test parameters. The International Fabricare Institute, formerly known as National Institute of Drycleaning (hereafter referred to as IFI), classes the C/G ratio result as poor if below 0.75, fair if between 0.75 and 1.5, good if between 1.5 and 3.0 and excellent if above 3.0. Invariably, the C/G results of detergents tested in a free water system prior to the present invention were in the poor-fair range.

As indicated above, it has previously been known to add small amounts of water to organic drycleaning solvents in an attempt to improve the cleaning ability of the system. However, it was also known that as the amount of water increased the effectiveness of the cleaning treatment decreased and the maximum addable amount of water was the amount of water which the fabric or garment to be cleaned would absorb. It has now been found that with the above imidazoline detergent the proper minimum amount of water is the minimum amount of water required to achieve a free water system. For this invention the point of free water is defined as when sufficient water has been added to the drycleaning bath so that an emulsion of water and detergent is formed. The actual amount of water required to achieve free water will vary depending on the type of fabric or fibers being cleaned, the amount of fibrous material per volume of drycleaning bath, the detergent employed and the amount of detergent added to the drycleaning bath. Typically, the condition is achieved after the addition of somewhere between one-half and four ounces of water per gallon of organic drycleaning solvent. In industrial cleaning practice, the achievement of free water is conveniently verified by the observing of a milk-like appearance of the cleaning bath. The amount of free water to be added is governed by the same factors which control the amount of detergent to be added. In accordance with this invention, the free water will be added in an amount from about one-half to about 15 ounces per gallon of organic drycleaning solvent and preferably from about one-half to about 6 ounces per gallon.

The use of free water with the imidazoline of this invention is dramatically illustrated when the C/G ratio is plotted on a graph as a function of water added (or even when the results are simply tabulated). As water is added to the cleaning system, the C/G ratio progressively worsens, i.e., goes lower, until the beginning amount of free water is achieved. The point of free water will occur slightly after the C/G ratio has reached a minimum value and starts to rise again with the addition of still more water. Thereafter, as additional amounts of free water is added, the C/G ratio progressively and rapidly improves, i.e., rises, and excellent C/G results on the IFI scale above are readily and conveniently obtained.

The organic drycleaning solvents suitable for this invention include aliphatic hydrocarbon and halogenated aliphatic hydrocarbon solvents, e.g., Stoddard solvent (including the quick evaporating and 140F variants), perchloroethylene, trichloroethane, trichloroethylene, and the chlorofluoro variants of the chlorinated hydrocarbons, e.g., trichlorotrifluoroethane, trichlorofluoromethane, dichlorofluoromethane, 1,1,2-trichloro-2,2-difluoroethane, 1,2-dichloro-1,1-difluoroethane, or mixtures of these solvents; and other conventional drycleaning solvents.

The following examples are included to illustrate the preparation and use of the compositions of the present invention but are not to be considered limiting. Unless otherwise specified, all parts are parts by weight and all temperatures are expressed as degrees Centigrade.

Following the procedure set forth in Bulletin T-444 of the National Institute of Drycleaning, three unsoiled cotton cloth swatches and three cotton swatches soiled with rug beater soil (all standard test swatches obtained from the International Fabricare Institute) were placed in the test container. The swatches prior to use had been stabilized to ambient laboratory temperature and humidity. The reference detergent was Aerosol OT (sodium di-(ethyl hexyl) sulfosuccinate). Unless otherwise specified the detergent concentration was one percent (v/v). The solvent used in the cleaning test was perchloroethylene. The swatches were machine cleaned for 1 hour at a temperature of approximately 78° Fahrenheit.

The swatches were cleaned in an apparatus often referred to as the "Launder-Ometer" which is the official method of American Association of Textile Chemists and Colorists which may be found in the association's Monograph No. 3, First Edition, published 1949, Second Edition published 1968. The apparatus consists essentially of a thermostatically controlled waterbath in which is mounted a rotary rack or frame so constructed that twenty 500-milliliter (ml) stainless steel cannisters may be clamped to it in rows of five opposite to each other. The six test swatches are placed in each cannister along with a measured volume of detergent solution and a number of ¼-inch diameter stainless steel balls. The total volume of water, detergent and solvent is 150 ml. As the cannister holder rotates, each cannister describes a complete circle causing the balls in the solution to tumble about. This supplies the mechanical action needed for good detergency.

Both before and after being subjected to the cleaning treatment, the amounts of soil removal, that is, the amount of cleaning performed on each swatch or soil redeposition on each swatch was determined by the use of the Reflectometer, manufactured by Hunter Associates Laboratory, using the Hunterlab D-40 green Reflectometer readings as the final result. The swatches were twice rinsed after cleaning and individually read to determine an average value. It should be noted that the detergent solution used in cleaning contained no thickener or antiredeposition agent in the formulation.

EXAMPLE 1

In this test the imidazoline evaluated according to the above test procedure was 1-hydroxyethyl-2-tall oil fatty acid imidazoline added in the amount of 0.1 ounce per gallon (or 0.078% v/v) of organic drycleaning solvent. The amount of water was varied as indicated. The C/G ratio index values were determined for each of the test swatches and are tabulated in Table I below.

EXAMPLE 2

Example 1 was repeated except that the imidazoline tested was added at the rate of 0.5 ounce per gallon (0.39% v/v) of organic drycleaning solvent. The results are also tabulated below in Table I.

EXAMPLE 3

Example 1 is repeated except the imidazoline is 1-hydroxyethyl-2-oleyl imidazoline.

EXAMPLE 4

Example 2 is repeated except the imidazoline is 1-hydroxyethyl-2-coconut fatty acid imidazoline.

TABLE I

| Water Added (ounces/gallon) | Cleaning Performance, C/G Index Example 1 | Example 2 |
|---|---|---|
| 0.0 | 1.07 | 1.45 |
| 0.5 | 0.83 | 1.14 |
| 2.0 | 1.77 | 2.09 |
| 4.0 | 2.37 | 3.41 |
| 6.0 | 2.49 | 3.73 |
| 8.0 | 3.00 | 3.54 |

From Table I it will be observed that the cleaning efficiency as measured by the C/G index values decreases as water is added until the point of free water is reached. Thereafter, contra to the prior art, the cleaning efficiency rises as free water is added and excellent cleaning results, by the IFI classification, are obtained. The ability to add additional, i.e., free water, is advantageous because it provides more water for the removal of greater amounts of water-soluble stains and soils. The typical detergent now employed in the drycleaning industry does not combine the ability to remove water-soluble stains and soils with the ability to avoid redeposition of other soils, i.e., keep soils suspended and have excellent C/G values.

EXAMPLE 5 (COMPARATIVE)

Example 2 is repeated except that the detergent imidazoline is 1-hydroxyethyl, 1-carboxyethyl, 2-oleyl imidazoline disclosed by U.S. Pat. No. 3,635,656 (Joseph A. Piepmeyer applicant) to be useful in drycleaning. When the foregoing imidazoline is added at the 0.5 ounce per gallon of drycleaning solvent and no water, the C/G index value is 1.97. However, when the water added is 4.0 ounces per gallon of drycleaning solvent, so that free water is present, the C/G index value is only 0.38.

The foregoing examples and methods have been described in the foregoing specification for the purpose of illustration and not limitation. Many other modifications and ramifications will naturally suggest themselves to those skilled in the art based on this disclosure. These are intended to be comprehended as within the skill of this invention.

The embodiments of the invention in which an exclusive property or privilege is claimed are defined as follows:

1. A drycleaning composition consisting essentially of a. from about 0.05 to about 1 ounce of a 1-hydroxyethyl-2-fatty acid imidazoline per gallon of solvent, b. from about one-half to about 15 ounces of free water per gallon of solvent, the expression free water is defined as when sufficient water has been added to the drycleaning bath so that an emulsion of water and detergent is formed, and c. a hydrocarbon or halogenated hydrocarbon drycleaning solvent.

2. The composition of claim 1 wherein the imidazoline is present in an amount from about 0.1 ounce to about 0.6 ounce per gallon of solvent.

3. The composition of claim 1 wherein the imidazoline is 1-hydroxyethyl-2-tall oil fatty acid imidazoline.

4. The composition of claim 1 wherein the imidazoline is 1-hydroxyethyl-2-coconut fatty acid imidazoline.

5. The composition of claim 1 wherein the imidazoline is 1-hydroxyethyl-2-oleyl imidazoline.

6. The composition of claim 1 wherein the free water is present in an amount from about one-half to about 6 ounces of free water per gallon of solvent.

7. A process for drycleaning fibrous material which comprises the steps of cleaning said fibrous material in a drycleaning bath composition as defined in claim 1.

8. The process of claim 7 wherein the imidazoline is 1-hydroxyethyl-2-tall oil fatty acid imidazoline.

9. The process of claim 7 wherein the imidazoline is present in an amount from about 0.1 to about 0.6 ounce per gallon of solvent.

10. The process of claim 7 wherein the free water is present in an amount from about one-half to 6 ounces per gallon of solvent.

* * * * *